US007420446B2

(12) United States Patent
Fushimi et al.

(10) Patent No.: US 7,420,446 B2
(45) Date of Patent: Sep. 2, 2008

(54) CIRCUIT BREAKER

(75) Inventors: Masahiro Fushimi, Tokyo (JP); Susumu Takahashi, Tokyo (JP); Kazumasa Watanabe, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 263 days.

(21) Appl. No.: 10/549,813

(22) PCT Filed: Oct. 27, 2004

(86) PCT No.: PCT/JP2004/015940

§ 371 (c)(1),
(2), (4) Date: Sep. 19, 2005

(87) PCT Pub. No.: WO2005/043574

PCT Pub. Date: May 12, 2005

(65) Prior Publication Data

US 2006/0267714 A1 Nov. 30, 2006

(30) Foreign Application Priority Data

Nov. 4, 2003 (JP) ..... 2003-374172
Jul. 15, 2004 (JP) ..... 2004-208640

(51) Int. Cl.
*H01H 67/02* (2006.01)
*H01H 73/02* (2006.01)

(52) U.S. Cl. ..... 335/6; 335/15; 335/129; 335/132

(58) Field of Classification Search ..... 335/6, 335/129–132, 15
See application file for complete search history.

(56) References Cited

U.S. PATENT DOCUMENTS 3,979,675 A * 9/1976 Maier ..... 335/16
3,991,290 A * 11/1976 Bayles et al. ..... 200/250
4,112,275 A * 9/1978 Kohler ..... 218/30
4,132,968 A * 1/1979 Lang ..... 335/16

(Continued)

FOREIGN PATENT DOCUMENTS

JP 4-312736 A 11/1992
JP 11-329134 A 11/1999
JP 2003-16902 A 1/2003

*Primary Examiner*—Ramon M Barrera
(74) *Attorney, Agent, or Firm*—Sughrue Mion, PLLC

(57) ABSTRACT

The circuit breaker of this invention comprises a pair of stationary contactors 2, 3 which are respectively provided with stationary contacts 2*a*, 3*a*, a movable contactor 4 which includes a pair of movable contacts 4*a* and which is capable of bridging both the stationary contactors, a switching mechanism section 10 which operates when an overcurrent has flowed through the stationary contactors, a crossbar 5 which separates the movable contactor from the stationary contactors upon the operation of the switching mechanism section, a contact pressure spring 7 which is engaged with the crossbar at one end and with substantially the central part of the movable contactor at the other end and which urges the movable contactor toward the stationary contactors, and arc extinction chambers 8 which are respectively disposed near both the end parts of the movable contactor and which extinguish an arc struck at the separation of the movable contactor from the stationary contactors.

9 Claims, 7 Drawing Sheets

U.S. PATENT DOCUMENTS 4,292,611 A * 9/1981 Bresson et al. ..... 335/6
4,307,358 A * 12/1981 Haury et al. ..... 335/6
4,408,173 A * 10/1983 Adlerteg et al. ..... 335/16
4,990,875 A * 2/1991 Lemarquand et al. ..... 335/131
5,163,175 A * 11/1992 Mori et al. ..... 335/132
5,233,321 A * 8/1993 Blanchard et al. ..... 335/132
6,034,585 A * 3/2000 Donhauser ..... 335/132
6,054,911 A * 4/2000 Herbst et al. ..... 335/132
6,150,909 A * 11/2000 Meier ..... 335/132
6,252,480 B1 6/2001 Kramer

* cited by examiner

CIRCUIT BREAKER

TECHNICAL FIELD

This invention relates to a circuit breaker which interrupts an electric current when an overcurrent has flowed through an electric path, and more particularly to a circuit breaker of bridge type whose breaking performance in a large current interrupting mode is enhanced.

BACKGROUND ART

A circuit breaker in the prior art has been configured in such a way that a molded case accommodates therein stationary contactors as which a pair of metal plates each being curved substantially in the shape of letter U are laterally disposed and which are arranged with their curved parts opposed through a spacing, a movable contactor which is disposed under the stationary contactors and which is capable of bridging the movable contactors, an inverted-U-shaped movable-contactor holder which holds the movable contactor so as to be movable in a vertical direction being a switching direction, by sidewalls disposed on both the sides of the movable contactor and which is movable in the switching direction of the movable contactor, a U-shaped holder support which includes guide portions disposed on both the outer sides of the sidewalls of the movable-contactor holder and which holds the movable-contactor holder so as to be slidable in the switching direction of the movable contactor, and a contact pressure spring which is interposed between the movable contactor and the holder support and which urges the movable contactor toward the movable-contactor holder, and that, when an overcurrent has flowed through the stationary contactors, a switching mechanism section moves the movable-contactor holder onto the side of the holder support while compressing the contact pressure spring, against the urging force of the contact pressure spring, thereby to separate the movable contactor from the stationary contactors (refer to, for example, Patent Document 1).

Patent Document 1: JP-A-2003-16902 (Sectors 0004-0007, FIGS. 3-5)

DISCLOSURE OF THE INVENTION

Problems that the Invention is to Solve

The prior-art circuit breaker has been configured as stated above, and has been incapable of attaining a favorable breaking performance for the reason that the movable contactor and the contact pressure spring are accommodated between the inverted-U-shaped movable-contactor holder and the U-shaped holder support, and that the contact pressure spring does not become smaller than predetermined dimensions even when compressed, so the movement magnitude of the movable contactor in the case of the separation thereof from the stationary contactors cannot be enlarged.

There has also been the problem that, since the insulation resistance between arcing contacts in the case of the separation of the movable contactor from the stationary contactors is low (any shield does not exist between the contacts), an arc becomes difficult to migrate onto the side of an arc extinction chamber, so a breaking performance in a circuit opening mode is inferior.

This invention has been made in order to solve the problems as mentioned above, and has for its object to provide a circuit breaker in which the movement magnitude of a movable contactor in the case of the separation thereof from stationary contactors can be enlarged, and in which the insulation resistance between contacts for moving an arc is enlarged, whereby a breaking performance in a circuit opening mode is good.

Means for Solving the Problems

A circuit breaker according to this invention comprises a pair of stationary contactors which are disposed in opposition to each other and each of which is provided with a stationary contact, a movable contactor which includes a pair of movable contacts respectively disposed in opposition to the stationary contacts and which is capable of bridging both the stationary contactors, a switching mechanism section which operates when an overcurrent has flowed through the stationary contactors, a crossbar which is engaged with a substantially central part of the movable contactor from a side of the stationary contactors and which separates the movable contactor from the stationary contactors upon the operation of the switching mechanism section, a contact pressure spring which is engaged with the crossbar at one end and with the substantially central part of the movable contactor at the other end and which urges the movable contactor toward the stationary contactors, and arc extinction chambers which are respectively disposed near both end parts of the movable contactor and which extinguish an arc struck at the separation of the movable contactor from the stationary contactors.

ADVANTAGES OF THE INVENTION

The circuit breaker according to this invention is configured as stated above, and the contact pressure spring does not interfere when the movable contactor is separated from the stationary contactors, so that the movement magnitude of the movable contactor can be enlarged, and a breaking performance in a circuit opening mode can be enhanced.

BEST MODE FOR CARRYING OUT THE INVENTION

Embodiment 1

Now, Embodiment 1 of this invention will be described with reference to the drawings.

FIG. 1 is a sectional view showing the circuit closing state of a circuit breaker in Embodiment 1 of this invention, FIG. 2 is a sectional view showing the circuit opening state of the same circuit breaker in Embodiment 1, FIG. 3 is a sectional view showing the circuit opening state of the circuit breaker in Embodiment 1 as based on electromagnetic repulsion, FIG. 4 is a perspective view of the essential portions of the circuit breaker in Embodiment 1, FIG. 5 is a sectional view taken along A-A in FIG. 4, FIG. 6 is an exploded perspective view corresponding to FIG. 4, and FIG. 7 is a perspective view of a commutating electrode in FIG. 1.

Referring to these figures, in the housing 1 of the circuit breaker 100, there are accommodated a pair of stationary contactors 2 and 3 as which metal plates each being curved substantially in the shape of letter U are laterally arranged in opposition through a spacing therebetween at substantially the central part of the housing 1 and have stationary contacts 2*a* and 3*a* secured to the lower ends of the respective metal plates, a movable contactor 4 which includes secured movable contacts 4*a* respectively disposed in opposition to the stationary contacts 2*a* and 3*a* and which bridges the stationary contactors 2 and 3 on the lower side of these stationary contactors, a crossbar 5 which includes depression portions 6 extending from the side of the stationary contactors to the side of the movable contactor through these stationary contactors and in which the lower ends of the depression portions 6 lie in engagement with substantially the central part of the movable contactor 4 so as to separate this movable contactor 4 from the stationary contactors 2 and 3, an overcurrent detection section 9 which detects a current flowing through the stationary contactors 2 and 3, a switching mechanism section 10 which operates on the basis of the detection result of the overcurrent detection section 9 and which presses the crossbar 5 downwards as viewed in the figure, contact pressure springs 7 each of which is engaged with the crossbar 5 at one end and with substantially the central part of the movable contactor 4 at the other end so as to urge this movable contactor 4 onto the side of the stationary contactors 2 and 3, and arc extinction chambers 8 which are respectively disposed near both the end parts of the movable contactor 4 and each of which is formed of a plurality of parallel plate-shaped grids 8*a* for extinguishing an electric arc struck when the movable contactor 4 has been separated from the stationary contactors 2 and 3.

A handle 11 for manually separating the movable contactor 4 from the stationary contactors 2 and 3, and a link 10*a* for transmitting the operation of the switching mechanism section 10 to the crossbar 5 are mounted on the switching mechanism section 10, and the link 10*a* and the crossbar 5 are held in engagement by a pin 12 which is snugly inserted into a slot 5*a* provided in the crossbar 5. Pins 13 are disposed in those engagement portions of the crossbar 5 each of which one end (the upper end in the figure) of the corresponding contact pressure spring 7 engages, and each of the pins 13 is snugly inserted into the corresponding one of inclined grooves 5*b* which are formed extending obliquely downwards from the side surface of the crossbar 5 as shown in FIG. 5.

Besides, the other end of each of the contact pressure springs 7 is held in engagement with the corresponding one of pins 14 which are fixed in engagement with the movable contactor 4.

The depression portions 6 for depressing the movable contactor 4 is provided at the lower end of the crossbar 5 as stated above, an accommodation portion 6*a* for accommodating the contact pressure spring 7 therein is disposed in each of the depression portions 6, a tubular cover member 15 which is formed so as to be slidable on the outer peripheral surface of the crossbar 5 is disposed so as to conceal the accommodation portion 6*a* as well as the contact pressure spring 7, and extension portions 15*a* as which contact surfaces to serve as parts fixed with the movable contactor 4 are extended near to the movable contacts 4*a*, and holding portions 15*b* which hold the lugs 4*c* of the movable contactor 4, are disposed at the lower end of the cover member 15.

Besides, the commutating electrodes 16 each of which commutates the arc struck when the movable contactor 4 has been separated from the stationary contactors 2 and 3 are secured to the bottom surface 1*a* of the housing 1 on the separation side of the movable contactor 4. As shown in FIG. 7, in each of the commutating electrodes 16, there are disposed abutment surfaces 16*a* with which the movable contactor 4 comes into touch in a circuit opening mode, insertion holes 16*b* which are located at both the end parts of the movable contactor 4 and through which arc horns 4*b*, each serving to move into the arc extinction chamber 8 the arc struck between the stationary contact 2*a* or 3*a* and the movable contact 4*a* when the movable contactor 4 is separated from the stationary contactors 2 and 3, are inserted, and parallel surfaces 16*c* which are formed substantially in parallel with the flat surfaces of the grids 8*a* at both the ends of this commutating electrode.

Next, the operation of the circuit breaker in Embodiment 1 will be described with reference to FIGS. 1 and 2.

(1) As shown in FIG. 1, in the circuit closing state, the movable contacts 4*a* of the movable contactor 4 abut on the stationary contacts 2*a* and 3*a* of the respective stationary contactors 2 and 3, and the movable contactor 4 is urged against the stationary contactors 2 and 3 by the contact pressure springs 7.

(2) When an overcurrent has flowed through the stationary contactors 2 and 3, the overcurrent detection section 9 detects this current, the switching mechanism 10 operates on the basis of the result of the detection, and the link 10*a* moves in the direction of arrow B in FIG. 1.

(3) The lower ends of the depression portions 6 of the crossbar 5 depress the movable contactor 4, and the movable contactor 4 is moved down in the illustration and is separated from the stationary contactors 2 and 3 as shown in FIG. 2.

(4) The movable contactor 4 is moved to the bottom surface 1*a* of the housing 1 after the arc horns 4*b* at both the ends have been inserted through the insertion holes 16*b* of the commutating electrodes 16.

(5) Although the arc is struck between the stationary contact 2*a* or 3*a* and the movable contact 4*a*, this arc migrates from the arc horn 4*b* into the arc extinction chamber 8, and it is commutated to the commutating electrode 16 and has its current limited, so that the overcurrent flowing through the stationary contactors 2 and 3 is interrupted.

The circuit breaker in this embodiment is configured as stated above, and the contact pressure springs 7 do not interfere when the movable contactor 4 is separated from the stationary contactors 2 and 3, so that the movement magnitude of the movable contactor 4 can be enlarged. Moreover, since the cover member 15 is arranged between the contacts between which the arc is switched, an insulation resistance enlarges, with the result that the arc becomes easy to migrate onto the side of the arc extinction chamber 8, and a breaking performance in the circuit opening mode can be enhanced. Further, since the contact pressure springs 7 are accommodated in the accommodation portions 6*a* of the crossbar 5 and are concealed by the cover members 15, they are not exposed to the arc and are not burnt.

Still further, the link 10*a* and the crossbar 5 are held in engagement by the pin 12 which is snugly inserted in the slot 5*a* formed in this crossbar 5, and the switching mechanism section 10 and the crossbar 5 are coupled versatilely, so that the driving force of the switching mechanism section 10 can be efficiently transmitted to the crossbar 5. Still further, the crossbar 5 is provided with the inclined grooves 5*b*, and the corresponding pin 13 which one end of the contact pressure spring 7 engages is snugly inserted into this inclined groove, so that the pins 13 are easily mounted on the crossbar 5, and these pins 13 are reliably located and held at predetermined positions.

Still further, since the insertion holes 16*b* through which the arc horns 4*b* of the movable contactor 4 are inserted are formed in each commutating electrode 16, the movement magnitude of the movable contactor 4 can be enlarged.

Still further, since the parallel surfaces 16*c* formed substantially in parallel with the flat surfaces of the grids 8*a* are disposed in each commutating electrode 16, the arc is smoothly commutated to the commutating electrode 16 when it migrates from the arc horn 4*b* into the arc extinction chamber 8.

Next, an operation in which, in a case where a large current such as short-circuit current has flowed through the stationary contactors 2 and 3, the movable contactor 4 is separated without waiting for the operation based on the overcurrent detection section 9 as well as the switching mechanism section 10, by electromagnetic repulsive forces acting between the stationary contactors 2 and 3 and the movable contactor 4, will be described with reference to FIGS. 1 and 3.

(1) When the large current such as short-circuit current has flowed through the stationary contactors 2 and 3, a current to flow through the stationary contactor 2 and a current to flow through the movable contactor 4, and a current to flow through the stationary contactor 3 and a current to flow through the movable contactor 4 are in reverse directions, respectively, and repulsive forces in the direction of arrow C in FIG. 1 are generated in the movable contactor 4.

(2) Owing to the repulsive forces, the movable contactor 4 is moved down in the illustration while the inner peripheral surfaces of the cover members 15 are sliding on the outer peripheral surfaces of the depression portions 6 of the crossbar 5 against the urging forces of the contact pressure springs 7, and this movable contactor 4 is separated from the stationary contactors 2 and 3.

(3) Although an arc is struck between the stationary contact 2*a* or 3*a* and the movable contact 4*a*, this arc migrates from the arc horn 4*b* into the arc extinction chamber 8, and it is commutated to the commutating electrode 16 and has its current limited, so that the large current flowing through the stationary contactors 2 and 3 is interrupted.

In the above operation, the inner peripheral surfaces of the cover members 15 move while sliding on the outer peripheral surfaces of the depression portions 6 of the crossbar 5, so that the movable contactor 4 is smoothly separated from the stationary contactors 2 and 3.

Moreover, each of the cover members 15 includes the extension portions 15*a* as which the contact surfaces to serve as the parts fixed with the movable contactor 4 are extended near to the movable contacts 4*a*, so that the arc becomes easy to migrate onto the side of the arc extinction chamber 8, and a breaking performance in the circuit opening mode can be enhanced.

By the way, in Embodiment 1 stated above, there has been described the configuration in which the cover members 15 are held in direct touch with the movable contactor 4. However, in a case where an intermediate member 17 which is formed of, for example, a brass plate as shown in FIG. 8 is interposed between the extension portions 15*a* of each cover member 15 and the movable contactor 4 in a shape in which the bent portions 17*a* of this intermediate member hang down from both the sides of the movable contactor 4 as shown in FIG. 9, heat which develops when the movable contactor 4 and the stationary contactors 2 and 3 come into and out of touch can be prevented from being conducted to the cover member 15 which is formed of, for example, a thermoplastic resin.

Embodiment 2

Next, Embodiment 2 of this invention will be described with reference to the drawings.

FIG. 10 is a sectional view showing the circuit closing state of a circuit breaker in Embodiment 2 of this invention, FIG. 11 is an enlarged perspective view of an opening-separation holding member which is constructed of a U-shaped member and which forms the principal part of Embodiment 2, FIG. 12 is an enlarged perspective view of the essential portions of a crossbar in FIG. 10, FIG. 13 is a sectional view showing the circuit opening state of the circuit breaker in Embodiment 2 of this invention, and FIG. 14 is a sectional view showing the circuit opening state of the same circuit breaker in Embodiment 2 as based on electromagnetic repulsion.

In these figures, the same reference numerals and signs are assigned to portions identical or corresponding to those in FIGS. 1-7, and the portions shall be omitted from description. As will be described in detail later, the point of difference from FIGS. 1-7 is that protrusions are formed on the inner surface of each cover member 15, while the opening-separation holding member constructed of the U-shaped member is accommodated in the part of each depression portion 6 of the crossbar 5 for accommodating a corresponding contact pressure spring 7, in a shape in which the opening-separation holding member is juxtaposed with the contact pressure spring 7, and that protrusions formed in the U-shaped member and the protrusions in the cover member 15 move while getting over each other, in the opening-separation mode of a movable contactor 4 based on electromagnetic repulsive forces, whereby the opening-separation state of the movable contactor can be held.

FIG. 11 shows the perspective view of each U-shaped member 18 which is accommodated in the part of the corresponding depression portion 6 of the crossbar 5 in FIG. 10, for accommodating the corresponding contact pressure spring 7. As shown in the figure, the U-shaped member 18 is such that a body 18*a* formed of an elastic member is curved into the shape of letter U, and that the outer surfaces of both arms 18*b* and 18*c* are formed with the first protrusions 18*d*.

Besides, as shown in FIG. 12, the second protrusions 15*c* which protrude inwards are formed on the inner surface of each cover member 15 so as to oppose to the outer surfaces of both the arms 18*b* and 18*c* of the U-shaped member 18.

As shown in FIG. 10, the second protrusions 15*c* are provided near the upper end part of the cover member 15, so as to lie above the first protrusions 18*d* of the U-shaped member and near the upper end part of the depression portion 6 of the crossbar 5 in a state where stationary contacts 2*a* and 3*a* and a movable contact 4*a* close a circuit.

In such a configuration, in a case where a large current has flowed through the circuit, and where an overcurrent detection section 9 detects this current to actuate a switching mechanism 10 and to separate the movable contactor 4 from stationary contactors 2 and 3 for opening the circuit, the crossbar 5 and the depression portions 6 are moved down, and the lower ends of the depression portions 6 depress the movable contactor 4, as described with reference to FIG. 2. As a result, the cover members 15 are also pressed down into a state shown in FIG. 13. Therefore, the correlation between each U-shaped member 18 and the corresponding cover member 15 is almost the same as in the state shown in FIG. 10, and the opening separation of the movable contactor 4 is reached.

However, in a case where a large current such as short-circuit current has flowed through the stationary contactors 2 and 3, the circuit breaker falls into a state shown in FIG. 14, for the reason that, as described with reference to FIG. 3, the movable contactor 4 is separated without waiting for the operation of the overcurrent detection section 9 as well as the switching mechanism section 10, by electromagnetic repulsive forces acting between the stationary contactors 2 and 3 and the movable contactor 4. Now, an operation in this case will be described.

(1) When the large current such as short-circuit current has flowed through the stationary contactors 2 and 3, a current to flow through the stationary contactor 2 and a current to flow through the movable contactor 4, and a current to flow through the stationary contactor 3 and a current to flow through the movable contactor 4 are in reverse directions, respectively, so that the electromagnetic repulsive forces in the direction of arrow E in FIG. 14 are generated in the movable contactor 4.

(2) Owing to the electromagnetic repulsive forces, the movable contactor 4 is moved down in the direction of the arrow E while the inner peripheral surfaces of the cover members 15 are sliding on the outer peripheral surfaces of the depression portions 6 of the crossbar 5 against the urging forces of the contact pressure springs 7, and this movable contactor 4 is separated from the stationary contactors 2 and 3. The second protrusions 15*c* formed on the inner surfaces of the cover members 15 are also moved in the direction of the arrow E by the movements of these cover members. Since, however, the crossbar 5 is not operating, the U-shaped members 18 are held fixed at their positions in FIG. 10, and hence, the second protrusions 15*c* of the cover members 15 come into engagement with the upper surfaces of the first protrusions 18*d* of the U-shaped members 18 in colliding fashion.

When the movable contactor 4 has been further moved in the direction of the arrow E in FIG. 14, the second protrusions 15*c* run on the first protrusions 18*d* of the U-shaped members 18 and flex both the arms 18*b* and 18*c* of the U-shaped members 18 inwards, whereby the second protrusions 15*c* get over the first protrusions 18*d* so as to lie below these first protrusions as shown in FIG. 14.

(3) Thereafter, the overcurrent detection section 9 detects the overcurrent, the switching mechanism 10 operates on the basis of the result of the detection, and a link 10*a* is moved in the direction of arrow G in FIG. 14 to press the movable contactor 4 onto the inner bottom surface 1*a* of a housing 1 in touch therewith. Therefore, forces reverse to the above act on the second protrusions 15*c* of the cover members 15 and the first protrusions 18*d* of the U-shaped members 18, and the first protrusions 18*d* of the U-shaped members 18 get over the second protrusions 15*c* of the cover members 15 from the state of FIG. 14 while both the arms 18*b* and 18*c* of the U-shaped members 18 are being flexed inwards, until these first protrusions 18*d* are moved below the second protrusions 15*c*, whereby the original state is restored. Since the switching mechanism 10 is operating in this operating course, the movable contactor 4 is not returned onto the side of the stationary contactors 2 and 3.

In the above operation, after the movable contactor 4 has been separated from the stationary contactors 2 and 3 by the electromagnetic repulsive forces, this movable contactor 4 is about to be returned onto the side of the stationary contactors 2 and 3 in a region of small current immediately before the completion of interruption. Since, however, the second protrusions 15*c* of the cover members 15 come into engagement with the first protrusions 18*d* of the U-shaped members 18 to prevent the movable contactor 4 from being returned, the current can be reliably interrupted without the re-touch of the movable contactor 4 with the stationary contactors 2 and 3.

Incidentally, regarding the above operation, U-shaped members 18 may well be symmetrically juxtaposed so as to lie on both the sides of the corresponding contact pressure spring 7 in each cover member 15, and the first protrusions 18*d* of each U-shaped member 18 may well be provided in bilateral symmetry in the respective arms 18*b* and 18*c* in a plurality of pairs. In this case, the breaking performance can be enhanced still more.

DESCRIPTION OF REFERENCE NUMERALS AND SIGNS

Figure 1:
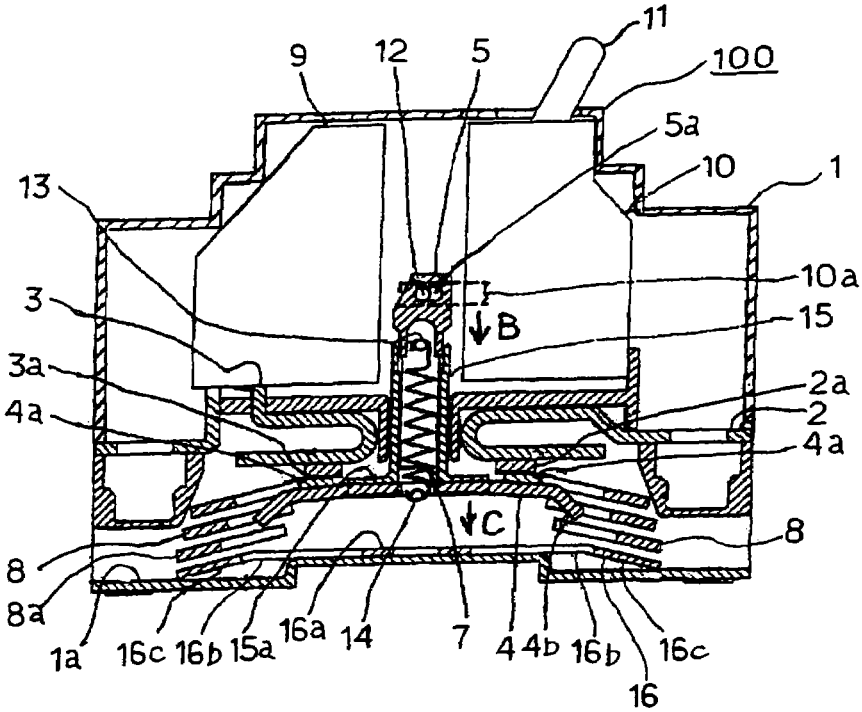
FIG. 1 is a sectional view showing the circuit closing state of a circuit breaker in Embodiment 1 of this invention.
Figure 2:
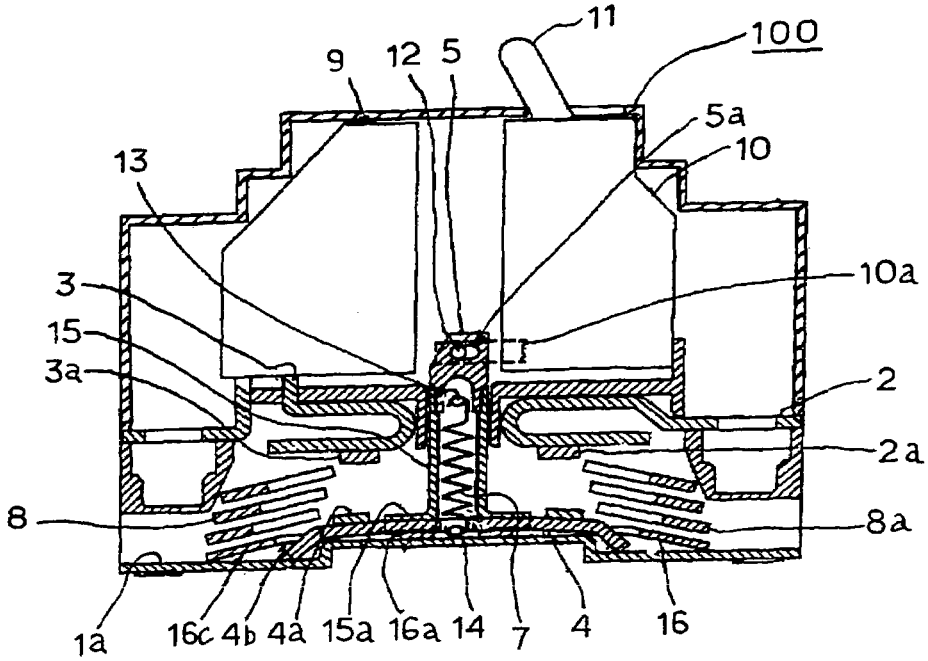
FIG. 2 is a sectional view showing the circuit opening state of the circuit breaker in Embodiment 1 of this invention.
Figure 3:
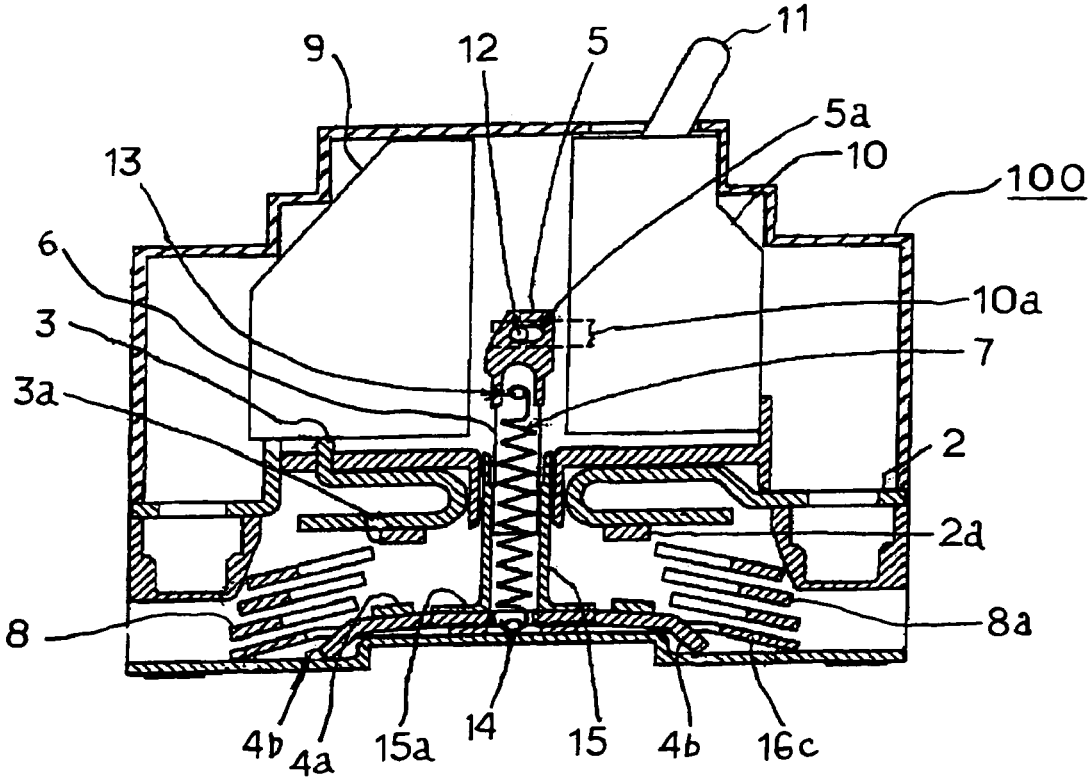
FIG. 3 is a sectional view showing the circuit opening state of the circuit breaker in Embodiment 1 of this invention as based on electromagnetic repulsion.
Figure 4:
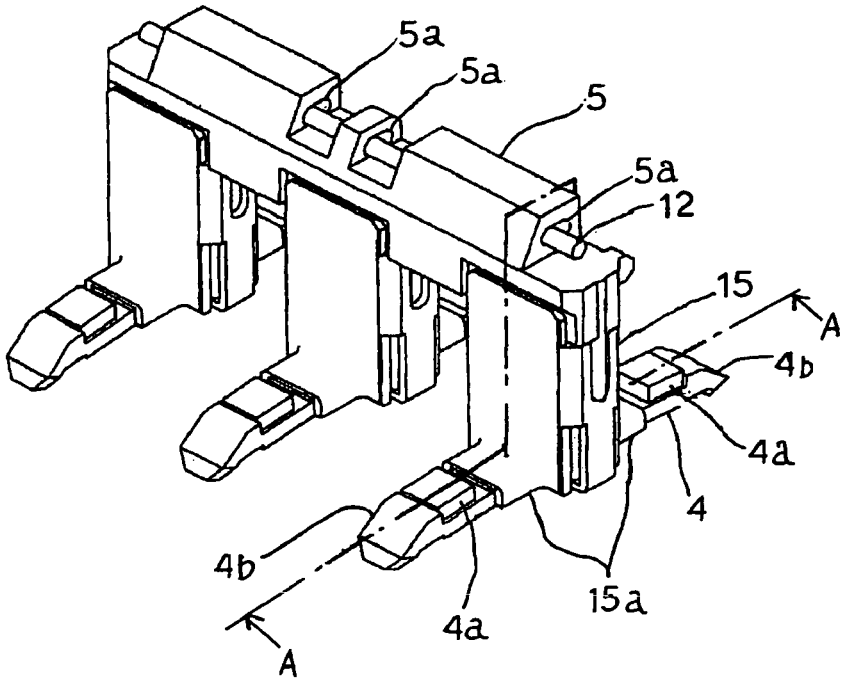
FIG. 4 is a perspective view of the essential portions of the circuit breaker in Embodiment 1 of this invention.
Figure 5:
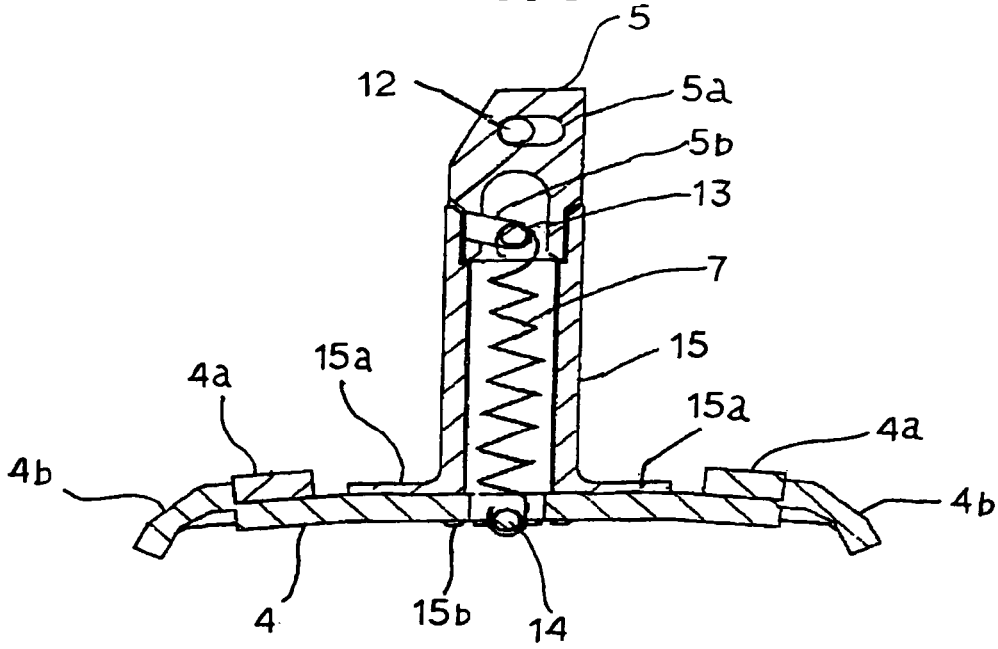
FIG. 5 is a sectional view taken along line A-A in FIG. 4.
Figure 6:
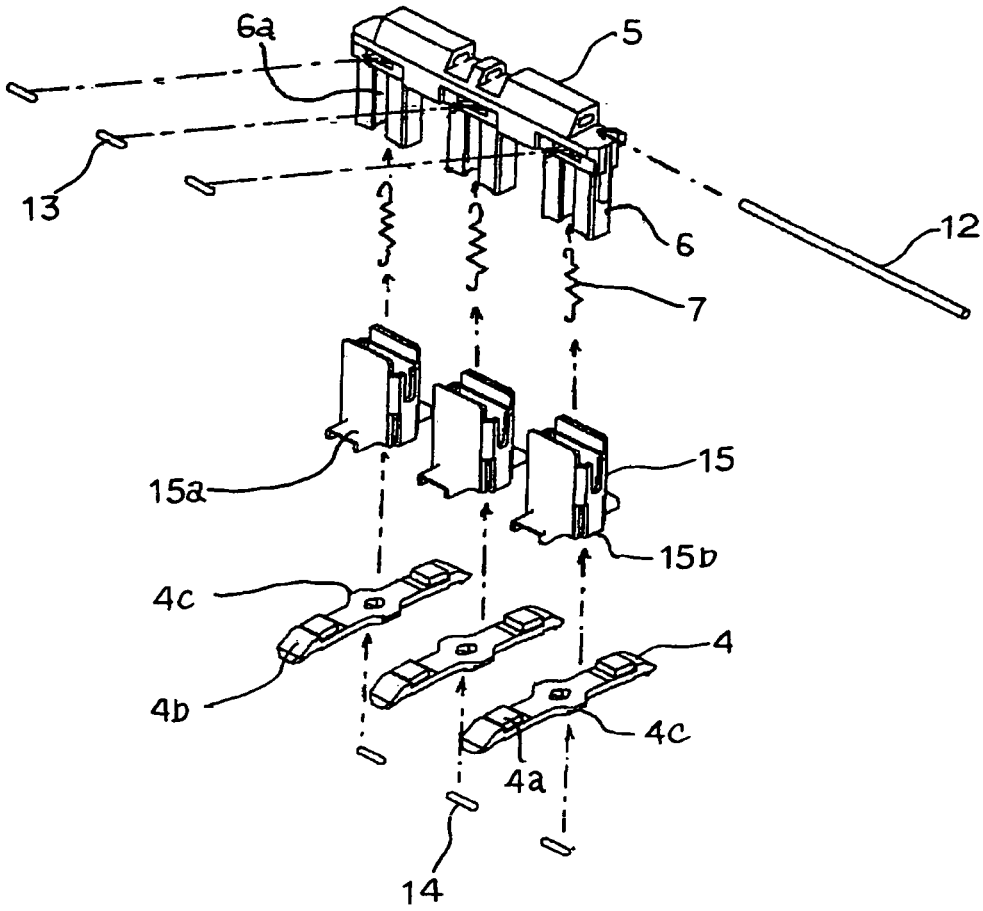
FIG. 6 is an exploded perspective view corresponding to FIG. 4.
Figure 7:
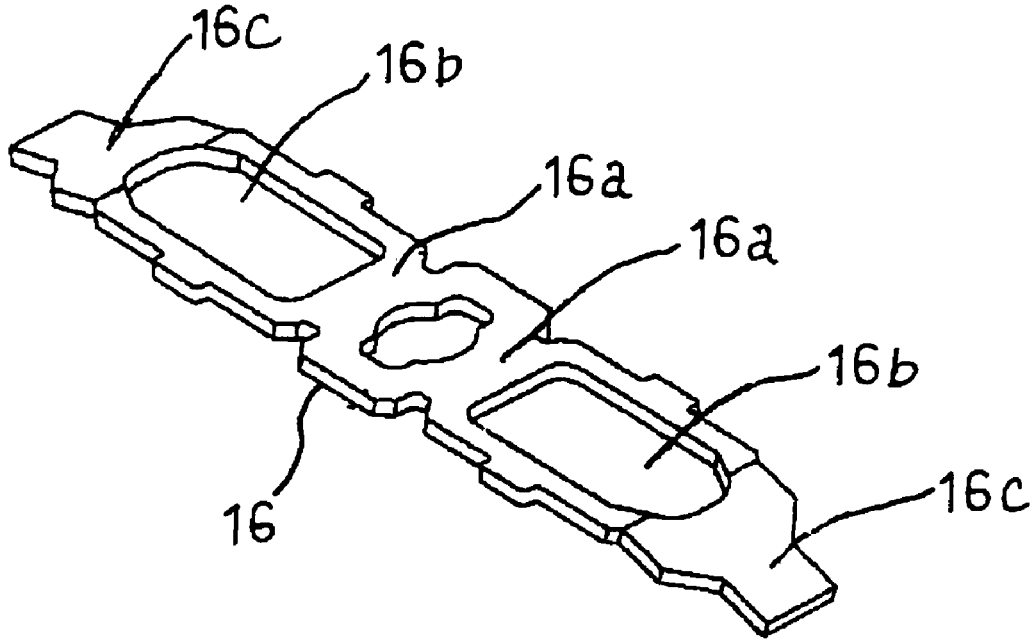
FIG. 7 is a perspective view of a commutating electrode in FIG. 1.
Figure 8:
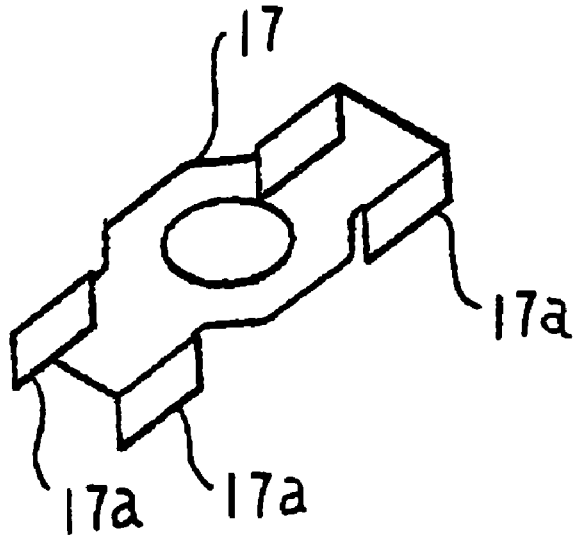
FIG. 8 is an enlarged perspective view of an intermediate member in FIG. 9.
Figure 9:
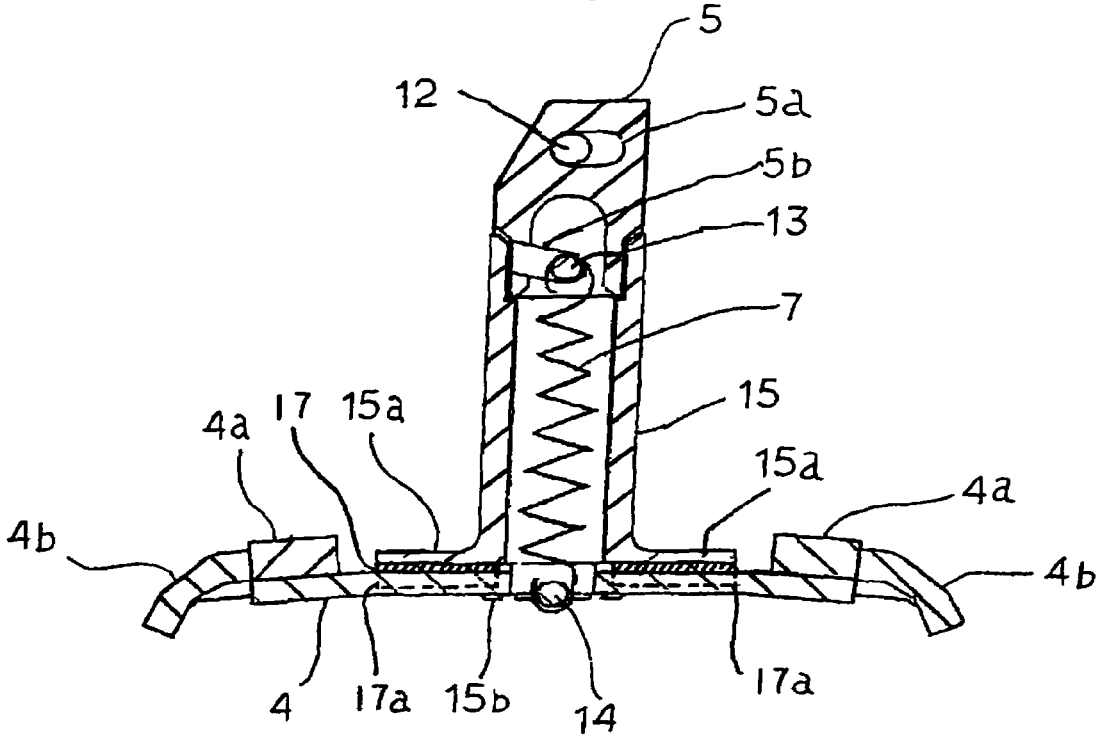
FIG. 9 is a sectional view showing the configuration of a modification to the circuit breaker in Embodiment 1 of this invention.
Figure 10:
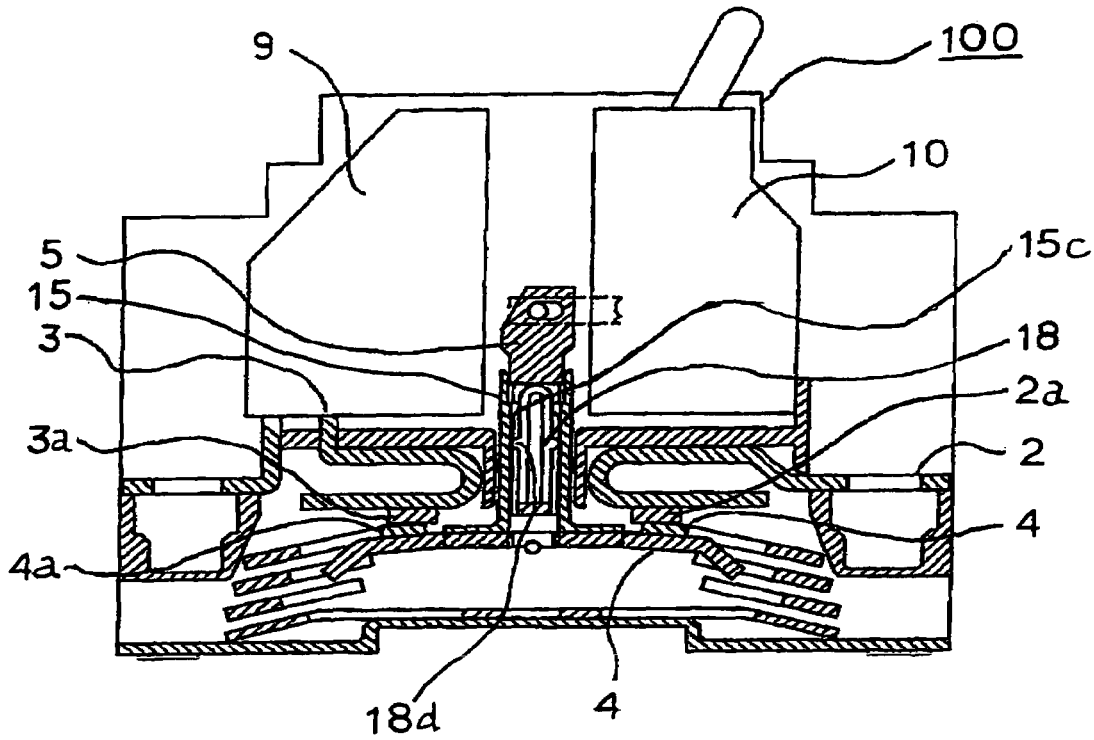
FIG. 10 is a sectional view showing the circuit closing state of a circuit breaker in Embodiment 2 of this invention.
Figure 11:
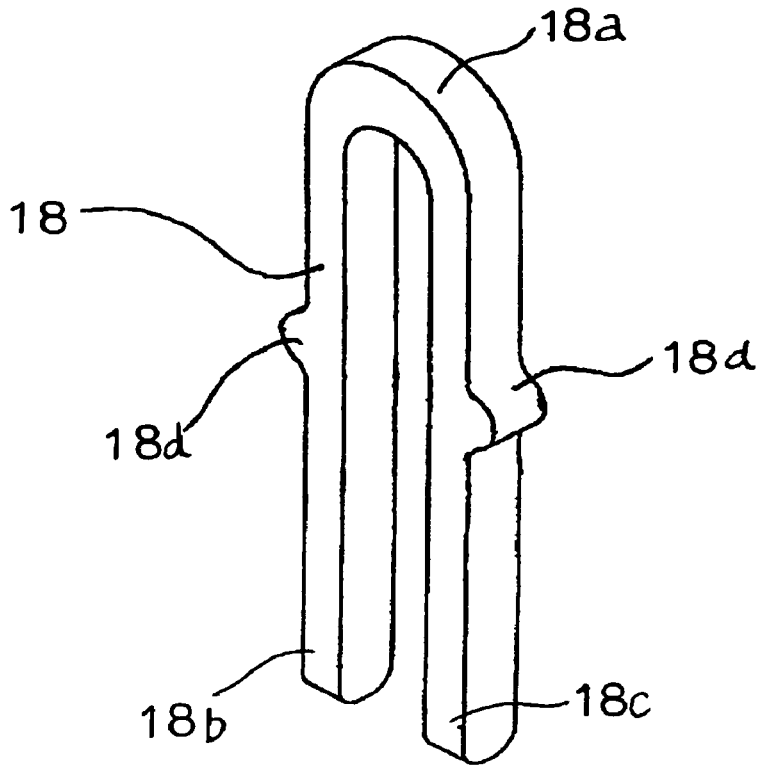
FIG. 11 is an enlarged perspective view showing the construction of a U-shaped member in FIG. 10.
Figure 12:
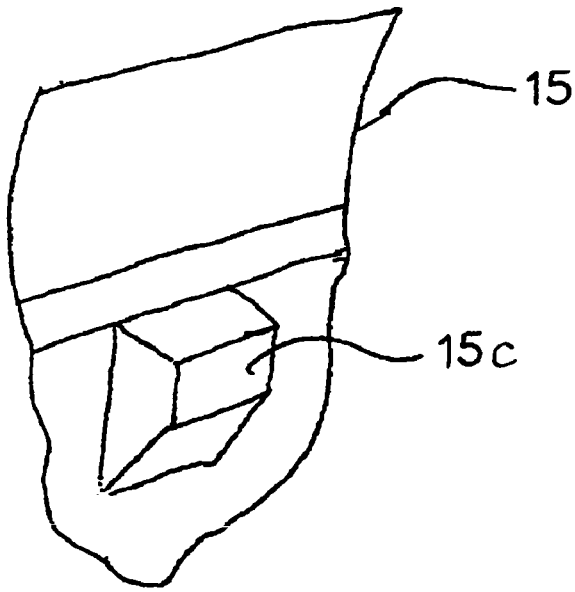
FIG. 12 is an enlarged perspective view of the essential portions of a crossbar in FIG. 10.
Figure 13:
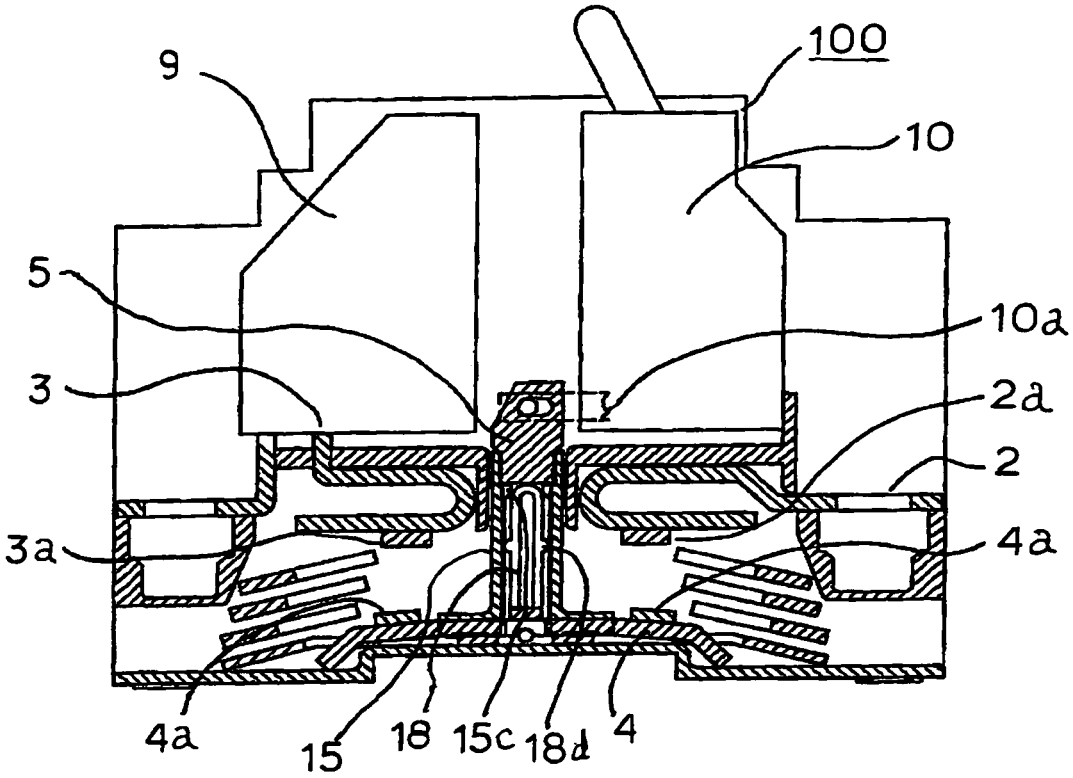
FIG. 13 is a sectional view showing the circuit opening state of the circuit breaker in Embodiment 2 of this invention.
Figure 14:
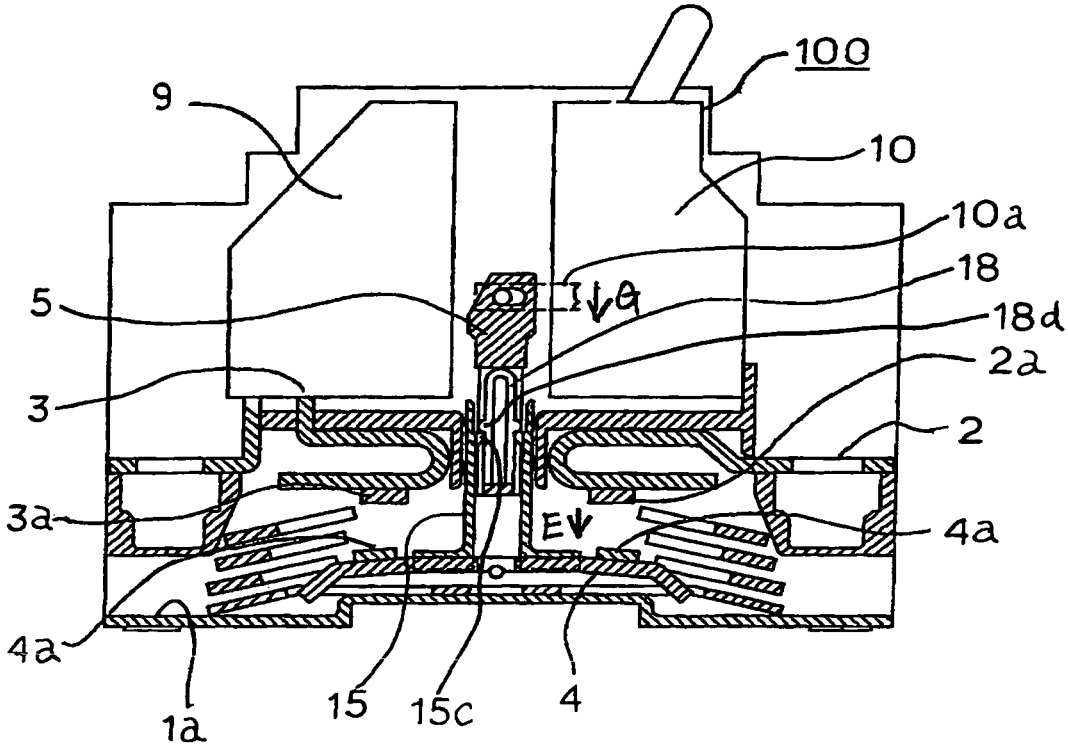
FIG. 14 is a sectional view showing the circuit opening state of the circuit breaker in Embodiment 2 of this invention as based on electromagnetic repulsion.

1 housing, 2, 3 stationary contactors, 4 movable contactor, 5 crossbar, 7 contact pressure spring, 8 arc extinction chamber, 9 overcurrent detection section, 10 switching mechanism section, 10*a* link, 12, 13, 14 pins, 15 cover member, 15*c* second protrusion, 16 commutating electrode, 17 intermediate member, 17*a* bent portion, 18 U-shaped member, 18*a* body, 18*b*, 18*c* arms, 18*d* first protrusion.

The invention claimed is:

1. A circuit breaker characterized by comprising a pair of stationary contactors which are disposed in opposition to each other and each of which is provided with a stationary contact, a movable contactor which includes a pair of movable contacts respectively disposed in opposition to the stationary contacts and which is capable of bridging both said stationary contactors, a switching mechanism section which operates when an overcurrent has flowed through said stationary contactors, a crossbar which is engaged with a substantially central part of said movable contactor from a side of said stationary contactors and which separates said movable contactor from said stationary contactors upon the operation of said switching mechanism section, a contact pressure spring which is engaged with said crossbar at one end and with the substantially central part of said movable contactor at the other end and which urges said movable contactor toward said stationary contactors, and arc extinction chambers which are respectively disposed near both end parts of said movable contactor and which extinguish an arc struck at the separation of said movable contactor from said stationary contactors, and further characterized in that said crossbar is formed with an inclined groove which extends obliquely downwards from a side surface thereof, and that a pin is snugly inserted into said inclined groove so as to be used as an engagement portion for one end of said contact pressure spring.

2. A circuit breaker characterized by comprising a pair of stationary contactors which are disposed in opposition to each other and each of which is provided with a stationary contact, a movable contactor which includes a pair of movable contacts respectively disposed in opposition to the stationary contacts and which is capable of bridging both said stationary contactors, a switching mechanism section which operates when an overcurrent has flowed through said stationary contactors, a crossbar which is engaged with a substantially central part of said movable contactor from a side of said stationary contactors and which separates said movable contactor from said stationary contactors upon the operation of said switching mechanism section, a contact pressure spring which is engaged with said crossbar at one end and with the substantially central part of said movable contactor at the other end and which urges said movable contactor toward said stationary contactors, and arc extinction chambers which are respectively disposed near both end parts of said movable contactor and which extinguish an arc struck at the separation of said movable contactor from said stationary contactors, further characterized in that said crossbar includes a depression portion which extends onto a side of said movable contactor and which depresses said movable contactor in engagement with substantially the central part of said movable contactor, and that an accommodation portion which accommodates said contact pressure spring therein is provided in said depression portion, and further characterized by comprising a tubular cover member which conceals said depression portion so as to be slidable on an outer peripheral surface of said depression portion and which is fixed to said movable contactor.

3. A circuit breaker as defined in claim 2, characterized in that said cover member has its fixation portion with said movable contactor extended near to said movable contacts.

4. A circuit breaker as defined in claim 2, characterized in that an intermediate member is interposed between fixed parts of said cover member and said movable contactor.

5. A circuit breaker as defined in claim 2, characterized by comprising a separation holding member which holds said movable contactor in a separated state when said movable contactor has been separated and moved by an electromagnetic repulsive force.

6. A circuit breaker as defined in claim 5, characterized in that said separation holding member is constructed as a U-shaped member which includes first protrusions on outer surfaces of both arms formed in a shape of letter U, that said separation holding member is juxtaposed with said contact pressure spring within said depression portion, and that said first protrusions are formed so as to be engageable with second protrusions which are formed on an inner surface of said cover member.

7. A circuit breaker characterized by comprising a pair of stationary contactors which are disposed in opposition to each other and each of which is provided with a stationary contact, a movable contactor which includes a pair of movable contacts respectively disposed in opposition to the stationary contacts and which is capable of bridging both said stationary contactors, a switching mechanism section which operates when an overcurrent has flowed through said stationary contactors, a crossbar which is engaged with a substantially central part of said movable contactor from a side of said stationary contactors and which separates said movable contactor from said stationary contactors upon the operation of said switching mechanism section, a contact pressure spring which is engaged with said crossbar at one end and with the substantially central part of said movable contactor at the other end and which urges said movable contactor toward said stationary contactors, and arc extinction chambers which are respectively disposed near both end parts of said movable contactor and which extinguish an arc struck at the separation of said movable contactor from said stationary contactors, and further characterized in that a commutating electrode which commutates an arc struck when said movable contactor has been separated from said stationary contactors is disposed on a side of said movable contactor remote from said stationary contactors.

8. A circuit breaker as defined in claim 7, characterized in that said commutating electrode includes insertion holes through which arc horns formed at both end parts of said movable contactor can be inserted at the separation of said movable contactor from said stationary contactors.

9. A circuit breaker as defined in claim 7, characterized in that parallel surfaces which are formed substantially in parallel with flat surfaces of grids of said arc extinction chambers are provided at both end parts of said commutating electrode.

* * * * *